US008656748B2

(12) United States Patent
Saitou

(10) Patent No.: US 8,656,748 B2
(45) Date of Patent: Feb. 25, 2014

(54) LUBRICANT FOR HOT-ROLLING TOOLS, AND SURFACE TREATMENT METHOD FOR MANDREL BAR FOR USE IN PRODUCING HOT ROLLING SEAMLESS TUBES

(75) Inventor: Kenichi Saitou, Kainan (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/562,573

(22) Filed: Jul. 31, 2012

(65) Prior Publication Data

US 2013/0008216 A1 Jan. 10, 2013

Related U.S. Application Data

(63) Continuation of application No. PCT/JP2011/000789, filed on Feb. 14, 2011.

(30) Foreign Application Priority Data

Feb. 15, 2010 (JP) ..... 2010-030024

(51) Int. Cl.
*B21B 45/02* (2006.01)

(52) U.S. Cl.
USPC ..... 72/42; 72/97; 508/125

(58) Field of Classification Search
USPC ..... 508/125, 156, 113; 72/41, 42, 97
See application file for complete search history.

(56) References Cited

U.S. PATENT DOCUMENTS 6,177,386 B1 * 1/2001 Aurin ..... 508/125
7,308,812 B2 * 12/2007 Iida et al. ..... 72/42
7,816,306 B2 * 10/2010 Sasaki et al. ..... 508/156
7,861,565 B2 * 1/2011 Saito et al. ..... 72/42
2007/0149413 A1 6/2007 Sasaki et al.

FOREIGN PATENT DOCUMENTS

| | | | | |
|---|---|---|---|---|
| CN | 1845982 | | 10/2006 | |
| CN | 1890356 | | 1/2007 | |
| CN | 101208160 | | 6/2008 | |
| CN | 101270317 | | 9/2008 | |
| EP | 2106863 | | 10/2009 | |
| JP | 06-262220 | | 9/1994 | |
| JP | 8-41474 | * | 2/1996 | ..... B21B 45/02 |
| JP | 08-165489 | | 6/1996 | |
| JP | 09-78080 | | 3/1997 | |
| JP | 10-121088 | | 5/1998 | |
| JP | 11-226614 | | 8/1999 | |
| JP | 2001-01016 | | 1/2001 | |
| JP | 2004-344923 | | 12/2004 | |

OTHER PUBLICATIONS

Database WPI Week 199635 XP002699441, Thomson Scientific, London, GB; 1996.

* cited by examiner

*Primary Examiner* — Edward Tolan
(74) *Attorney, Agent, or Firm* — Clark & Brody

(57) ABSTRACT

A lubricant for hot-rolling tools in which an oxide-based laminar compound such as potassium tetrasilicic mica, sodium tetrasilicic mica, vermiculite, and bentonite, a boric acid compound such as boric acid, potassium borate, and sodium borate, and graphite are dispersed and dissolved in water, and in which the blending proportion of the oxide-based laminar compound to the boric acid compound is, in mass ratio, 10:90 to 70:30, and the content of the graphite is 1.0 to 4.5%. Applying this lubricant on the surface of the mandrel bar at the time of mandrel mill rolling enables a lubricating film to be formed on the surface of the bar and to exert excellent seizure resistance, and also allows the lubricant to be immune from remaining in the inner surface of tube.

2 Claims, 1 Drawing Sheet

| | Lubricant A (Graphite 0%) | Lubricant C (Graphite 2.5%) | Lubricant D (Graphite 4.5%) | Lubricant F (Graphite 10.0%) |
|---|---|---|---|---|
| Lubricant Remaining State | × | ○ | ○ | ○ |
| Film Formation State | ○ | ○ | ○ | △ |

LUBRICANT FOR HOT-ROLLING TOOLS, AND SURFACE TREATMENT METHOD FOR MANDREL BAR FOR USE IN PRODUCING HOT ROLLING SEAMLESS TUBES

TECHNICAL FIELD

The present invention relates to a lubricant for hot-rolling tools, and a surface treatment method for a mandrel bar for use in producing hot rolling seamless tubes, whereby a film excellent in lubricity is formed on the surface of the mandrel bar by applying the afore-mentioned lubricant on the surface of the mandrel bar.

It is noted that terms used herein have, unless otherwise defined, the following meanings.

"Boric acid-mica based lubricant" refers to a lubricant in which an oxide-based laminar compound of natural or artificial mica having a laminar structure, and boric acid or/and a boric acid compound are blended.

"Graphite-based lubricant" refers to a lubricant which includes graphite as the base material.

BACKGROUND ART

When a seamless tube is produced by a Mannesmann-mandrel mill tube-making machine, in an elongation rolling process of mandrel mill rolling, the rolling is performed by grooved rolls in a multi-stand rolling mill which feeds a blank tube in an axial direction while constraining the outer surface of the blank tube, along with a mandrel bar which constrains the inner surface of the blank tube.

When performing the elongation rolling, generally, a lubricating film predominantly composed of a solid lubricant such as graphite etc. is formed on the surface of the mandrel bar in advance; however, since the mandrel bar and the inner surface of the blank tube come into a condition of severe sliding friction, it is not easy to realize a complete lubrication state, and surface damages such as repeated wear, seizing, surface roughening/deterioration, and cracks are liable to occur.

As the surface condition of the mandrel bar which is used in a repeatedly circulated manner degrades depending on the use thereof, the mandrel bar will be temporarily displaced from the circulation line so that surface conditioning is performed; in this connection, particularly in the rolling of seamless tubes made of high-alloy steel and stainless steel as material grade, frequencies of surface conditioning of the mandrel bar are increased, resulting in a factor to deteriorate productivity. For this reason, conventionally, countermeasures to extend the useful life of the mandrel bar and to reduce frequencies of surface conditioning of the mandrel bar have been performed.

For example, Patent Literature 1 proposes a mandrel bar for hot-rolling a seamless tube, in which a scale layer having a thickness of 6 to 20 μm is formed on the surface of the mandrel bar of which centerline average roughness Ra is not more than 20 μm. The formation of the scale layer is performed by keeping the mandrel bar at 600 to 650° C. under an oxidizing atmosphere for a predetermined time period.

Moreover, Patent Literature 2 proposes a mandrel bar for producing hot rolling seamless tubes having a nitrided layer, of which centerline average roughness in the axial direction is 0.5 to 5.0 μm, on the surface of the substrate material. It is stated that by increasing the surface strength by forming a nitrided layer on the surface, and further controlling an optimum surface roughness in the nitrided mandrel bar, it is made possible to achieve an excellent service life even when performing mandrel mill rolling of a seamless tube made of high-alloy steel as material grade, and to significantly improve the inner surface quality of a resultant product.

However, applying the processing to form the scale layer and the nitrided layer as described in Patent Literature 1 or 2 to a hot-rolling tool having a long and heavy body, such as a mandrel bar for producing hot rolling seamless tubes, requires dedicated facilities therefor and is not necessarily easy.

Patent Literature 3 proposes a mandrel bar for producing hot rolling seamless tubes, in which a Cr-plated film having a thickness of 60 to 200 μm is formed on the surface of the substrate metal. It is stated that by increasing the thickness of the plated film than before, the service life of the mandrel bar is significantly improved even when subjected to the rolling of high-alloy steel containing not less than 2 wt % of Cr; however, the formation of a Cr-plated film is required and therefore an increase of cost is inevitable.

Further, Patent Literature 4 discloses a method for improving the service life of mandrel bar, in which upon regenerating the mandrel bar which has undergone wear and deterioration of the surface thereof and has become non-usable, the mandrel bar after use is subjected to heat treatment at a temperature, as being not more than the initial tempering temperature during new production, to homogenize the surface hardness, and after not less than 0.06 mm of the surface of the mandrel bar is ground or machined and then polished, a scale film for seizure resistance is formed thereon.

According to the method of Patent Literature 4, it is possible to significantly reduce the amount of machining of outer diameter compared with a conventional method for regenerating a mandrel bar in which after lubricant is removed, the diameter is machined by about 5 to 20 mm, thereby significantly improving the service life and specific consumption of the mandrel bar. However, specific processes such as for applying pre-heat treatment on the mandrel bar become needed.

Further, Patent Literature 5 proposes a lubricant composition for high-temperature rolling, which is obtained by blending one or more particulate oxide-based laminar materials selected from potassium tetrasilicic mica, sodium tetrasilicic mica, and the like, and one or more binders selected from boron oxide, alkali metal borate, and the like at a predetermined weight ratio. It is stated that this lubricant composition exhibits excellent lubricity and, in addition, does not cause inconveniences such as forming a carburized layer and a phosphorized layer in the material to be processed since it does not include graphite and phosphoric acid.

By the way, conventionally, when producing a seamless steel tube made of high-alloy steel and stainless steel with a mandrel mill, a so-called launching rolling is performed wherein a newly made mandrel bar is used for the first time, graphite is applied on the surface of the mandrel bar as a lubricant and a seamless tube made of carbon steel as workpiece is rolled.

In other words, that is a method in which since seizing occurs if tubes made of high-alloy steel and the like are rolled by using a newly fabricated mandrel bar; in the first stage of the use of mandrel bar, the launching rolling for initial use is performed for a predetermined number of times for tubes made of carbon steel as workpieces, thereby forming a film made up of graphite and a scale, the film having a high adhesiveness, on the surface, causing consolidation/densification of the structure, reducing the friction coefficient of the surface of the mandrel bar, and thereafter rolling a steel tube made of high-alloy steel, stainless steel, or the like by using the mandrel bar. This will make it possible to produce a hot seamless steel tube made of high-alloy steel and stainless steel by using general graphite as a lubricant without spending surplus processes and man hours.

However, growing demands in recent years on high-alloy steel tubes, such as of 13-Cr steel, and stainless steel tubes make it difficult to obtain the workpiece (carbon steel) for the launching rolling for initial use, and it is necessary to reduce friction coefficient and improve seizure resistance for newly fabricated mandrel bars right in the first stage of use.

CITATION LIST

Patent Literature

Patent Literature 1: Japanese Patent Application Publication No. 2004-344923

Patent Literature 2: Japanese Patent Application Publication No. 6-262220

Patent Literature 3: Japanese Patent Application Publication No. 2001-1016

Patent Literature 4: Japanese Patent Application Publication No. 11-226614

Patent Literature 5: Japanese Patent Application Publication No. 9-78080

SUMMARY OF INVENTION

Technical Problem

It is an object of the present invention to provide a lubricant for hot-rolling tools excellent in seizure resistance, and a surface treatment method for a mandrel bar for use in producing hot rolling seamless tubes, in which when producing a seamless tube by a mandrel mill, the lubricant is applied to the surface of the mandrel bar to form a film excellent in lubricity on the surface thereof.

Solution to Problem

To solve the above described problems, the present inventors have conducted a study on utilization of a lubricant which includes an oxide-based laminar compound, such as sodium tetrasilicic mica having a laminar structure as with graphite, as the base material of the lubricant and, to make it tenaciously adhere to the surface of the tool such as a mandrel bar, is blended with potassium borate (a boric acid compound) and the like.

To be specific, in the production of a seamless tube by a Mannesmann-mandrel mill process using a mandrel bar, the presence or absence of film formation on the surface of the mandrel bar was studied and, further, friction coefficient was evaluated when producing a seamless tube of 54.0 mm in outside diameter and 6.55 mm in wall thickness made of SUS304 stainless steel by using a lubricant (manually applying it to the surface of the mandrel bar) having a composition consisting of sodium tetrasilicic mica: 15.0%, potassium borate: 8.0%, amine borate: 8.0%, disperser: 2.5%, and water: 66.5% (herein, each "%" means "mass %").

As a result, when the lubricant of the above described composition (hereafter, a lubricant in which an oxide-based laminar compound such as sodium tetrasilicic mica and a boric acid compound such as potassium borate are blended is referred to as a "boric acid-mica based lubricant") was used, a film made up of silicic acid and a scale, and a film made up of boric acid and a scale were formed on the surface of the mandrel bar, and the presence of $(Mg, Fe)_2SiO_4$ in the film of "silicic acid+scale", and the presence of $Fe_3BO_5$ in the film of "boric acid+scale" could be confirmed by X-ray analysis.

FIG. 1 is a diagram to show the relationship between the friction coefficient and the number of passes of rolling at the time of mandrel mill rolling of SUS304 stainless steel in the case where a boric acid-mica based lubricant having the above described composition is used, in comparison with the case where a graphite-based lubricant is used. It is noted that the friction coefficient is determined from the following Formula (i) by measuring a total load ΣP in a steady state wherein a load is applied to all the stands and a thrust force F which acts on the mandrel bar during mandrel mill rolling.

$$\text{Friction coefficient} = F/\Sigma P \quad \text{(i)}$$

It is revealed that as shown in FIG. 1, the friction coefficient during rolling remarkably decreases when the boric acid-mica based lubricant is used (indicated by symbol ○ in the figure) compared with the case where the graphite-based lubricant is used (indicated by symbol Δ). When the boric acid-mica based lubricant is used, the friction coefficient further decreases after the second pass of rolling.

The reason of this is inferred that a film having a high lubricity, which is made of "silicic acid+scale" based on sodium tetrasilicic mica, and "boric acid+scale" based on potassium borate and amine borate, has been formed on the surface of the mandrel bar through the pass of rolling, and repeating the pass of rolling causes such films to further consolidate/densification.

Further, when two passes of launching rolling for initial use were performed with the above described boric acid-mica based lubricant being applied to a newly fabricated mandrel bar, and thereafter above-described SUS304 stainless steel tubes were rolled in 5 consecutive passes, no seizing could be discerned on the surface of the mandrel bar. As shown in FIG. 1, since the friction coefficient is small from the first use of the mandrel bar, it is considered that the step of the launching rolling for initial use can be eliminated.

However, an investigation thereafter has revealed that there is a risk that lubricant remains on the inner surface of tube in a foam-like shape, and which is mistakenly regarded as inner surface flaws in an inspection. The remaining of lubricant will not pose a problem since pickling is performed in the case of a stainless steel tube and the remaining lubricant is collaterally removed in that occasion; however, in the cases of a 9-Cr steel tube and a 13-Cr steel tube, it is necessary to add the step of removing the remaining lubricant exclusively.

Such a problem will not occur when graphite is used as the lubricant. Accordingly, the present inventors have investigated the remaining of lubricant on the inner surface of tube, and the formation of film on the surface of the mandrel bar by, as an experiment, adding graphite to a boric acid-mica based lubricant with variation of its ratio, and have found that when graphite is added, the lubricant does not remain even if the amount of addition is small, thus leading to a satisfactory result.

Moreover, it is also found that when the content of graphite is not more than a predetermined ratio, the above described film of the surface of the mandrel bar, that is, the film (silicic acid+scale film/boric acid+scale film) which is formed when the boric acid-mica based lubricant is used is satisfactorily formed as well.

The present invention has been made in view of the above described findings, and it essentially pertains to a lubricant for hot-rolling tools of (1) described below, and a surface treatment method for a mandrel bar for use in producing hot rolling seamless tubes of (2) described below. It is noted that hereafter, "%" that represents the content of each component (blended substance) constituting the lubricant means "mass %".

(1) A lubricant for hot-rolling tools, in which an oxide-based laminar compound, a boric acid compound, and graphite are dispersed and dissolved in water, wherein the blending proportion of the oxide-based laminar compound to the boric acid compound is 10:90 to 70:30 in mass ratio, and the content of the graphite is 1.0 to 4.5%.

Here, examples of "oxide-based laminar compound" include natural or artificial mica. The mica is exemplified by potassium tetrasilicic mica $\{KMg_{2.5}(Si_4O_{10})F_2\}$, sodium tetrasilicic mica $\{NaMg_{2.5}(Si_4O_{10})F_2\}$, natural gold mica $\{KMg_3(AlSi_3O_{10})(OH)_2\}$, and the like. Moreover, vermiculite $\{(Mg, Fe)_3(Si, Al, Fe)_4O_{10}(OH)_2.4H_2O\}$, bentonite $\{Si_2(Al_{3.34}Mg_{0.44})_4O_{20}(OH)_4Na_{0.44}\}$, and the like can be used as the "oxide-based laminar compound".

The above described "boric acid compound" refers to boric acid and/or boric acid compound. Examples of boric acid compound include, besides boric acid, alkali metal borates such as potassium borate and sodium borate, boron oxides, and further organic compounds including boron such as amine borates.

In the lubricant for hot-rolling tools of the present invention, arranging the content of graphite to be not less than 1.0% can effectively deter the lubricant from remaining in a foam-like shape. On the other hand, arranging the content of graphite to be not more than 4.5% is for the purpose of satisfactorily forming a film on the surface of the mandrel bar.

If the composition of the lubricant for hot-rolling tools (including lubricants of which the content of graphite is defined as described above) of the present invention consists of mica: 10 to 30% as oxide-based laminar compound, boric acid: 10 to 30% as boric acid compound, graphite: 1.0 to 4.5%, the balance being water, the lubricating film is uniformly formed, and there will be no lubricant remaining on the inner surface of tube, which is desirable.

(2) A surface treatment method for a mandrel bar for use in producing hot rolling seamless tubes, wherein the lubricant for hot-rolling tools according to the above described (1) is applied to the surface of the mandrel bar at the time of mandrel mill rolling.

Advantageous Effects of Invention

The lubricant for hot-rolling tools and the surface treatment method for a mandrel bar for use in producing hot rolling seamless tubes of the present invention exhibit the following remarkable advantageous effects.

(1) Being excellent in seizure resistance and satisfactory in workability as a lubricant for hot rolling.

(2) Capable of forming a film excellent in lubricity on the surface of the mandrel bar thereby achieving excellent seizure resistance at the time of production of seamless tubes by a mandrel mill.

(3) Lubricant is immune from remaining on the inner surface of tube at the time of production of seamless tubes by a mandrel mill.

(4) In particular, when producing a hot seamless steel tube made of high-alloy steel or stainless steel by using a newly fabricated mandrel bar, it is possible to eliminate a launching rolling for initial use with carbon steel as the workpiece, the launching rolling having been necessary when a conventional graphite based lubricant was used, thereby significantly improving working efficiency.

DESCRIPTION OF EMBODIMENTS

Figure 1:
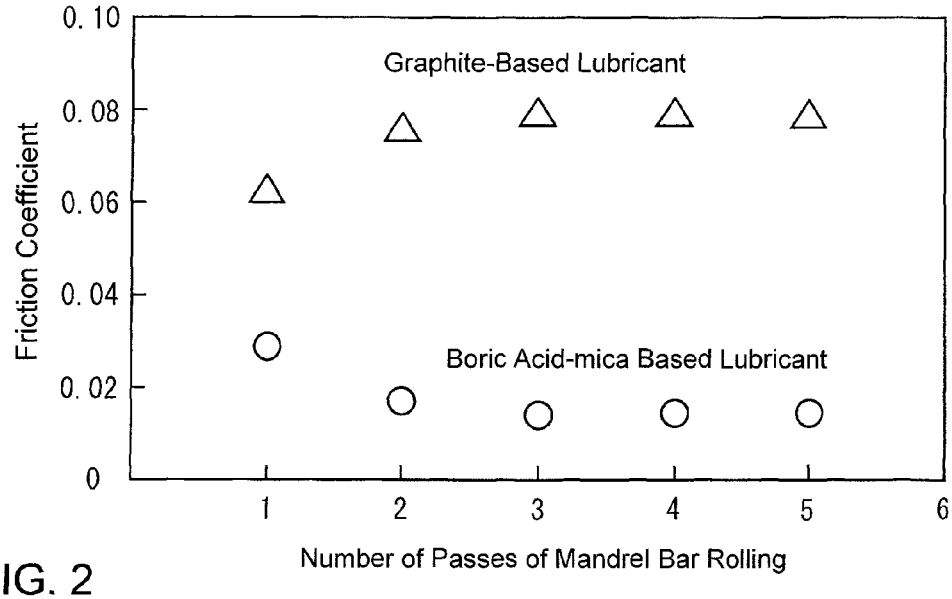
FIG. 1 is a diagram to show the relationship between the friction coefficient and the number of passes of rolling at the time of mandrel mill rolling of SUS304 stainless steel tubes in the case where the boric acid-mica based lubricant is used, in comparison with the case where a graphite based lubricant is used.

The lubricant for hot-rolling tools of the present invention is, as described above, a lubricant for hot-rolling tools, in which an oxide-based laminar compound, a boric acid compound, and graphite are dispersed and dissolved in water, wherein the blending proportion of the oxide-based laminar compound to the boric acid compound is 10:90 to 70:30 in mass ratio, and the content of the graphite is 1.0 to 4.5%.

The reason why the oxide-based laminar compound and the boric acid compound are blended in a predetermined ratio in the lubricant of the present invention is to arrange that the lubricant tenaciously adheres to the surface to be lubricated thereby decreasing the friction coefficient between the tube metal and the mandrel bar, and improving lubricity at the time of hot rolling, particularly mandrel mill rolling. The oxide-based laminar compound serves to prevent the seizing between the tube metal and the mandrel bar and, on the other hand, the boric acid compound functions to make the oxide-based laminar compound uniformly disperse over and tenaciously adhere to the friction surfaces between the tool and the workpiece, and acts by itself as a lubricant film.

Typical oxide-based laminar compounds to be blended in the lubricant of the present invention include micas such as potassium tetrasilicic mica, sodium tetrasilicic mica, and natural gold mica. One or more kinds of these micas may be used. Moreover, in place of micas, or along with micas, vermiculite, bentonite, and like may also be used. It is noted that sodium tetrasilicic mica is most preferable.

As the boric acid compound, in general, one or more kinds of boric acid, potassium borate, sodium borate, and the like may be used.

The reason why the blending proportion of oxide-based laminar compound to boric acid compound is arranged to be, in mass ratio, 10:90 to 70:30, that is, within the range of 9 to 0.43 parts of boric acid compound for one part of oxide-based laminar compound is that if the blending proportion of oxide-based laminar compound to boric acid compound is out of this range, the lubricity deteriorates and inner surface flaws are more likely to occur, for example, at the time of mandrel mill rolling.

When one or more kinds of potassium tetrasilicic mica, sodium tetrasilicic mica, natural gold mica, vermiculite, bentonite, and like are mixed and used as the oxide-based laminar compound, or one or more kinds of boric acid, potassium borate, sodium borate, boron oxide, and further amine borates and the like are mixed and used as the boric acid compound, it may be arranged such that the proportion (mass ratio) of the total amount of the used oxide-based laminar compounds to the total amount of the used boric acid compounds is within the range of 10:90 to 70:30.

The purpose of arranging that graphite other than oxide-based laminar compound and boric acid compound is contained in the lubricant of the present invention is to deter the lubricant from remaining on the inner surface of tube at the time of hot rolling, for example, mandrel mill rolling.

Although the mechanism by which the lubricant remains inside the tube is not clear, it is presumably because an oxide-based laminar compound such as sodium tetrasilicic mica and a boric acid compound such as potassium borate melt along with a scale while mandrel mill rolling is performed or while heating is performed in a reheating furnace after the end of rolling, and remain in a foam-like shape.

As the graphite, besides artificial graphite, natural graphite which exhibits scaly, lump-like, or soil-like shape may be used.

In the lubricant of the present invention, adding a small amount of graphite to the boric acid-mica based lubricant is important in configuration, in which the content of graphite is arranged to be 1.0 to 4.5%. That is, if the content of graphite is not less than 1.0%, it is possible to suppress the remaining of foam-like lubricant and, on the other hand, if the content is more than 4.5%, the characteristic of boric acid-mica based lubricant deteriorates, and the film formation state on the surface of the mandrel bar deteriorates.

The lubricant for hot-rolling tools of the present invention is one in which the above described oxide-based laminar compound, boric acid compound, and graphite are dispersed and dissolved in water.

The amount of water in dispersing and dissolving the oxide-based laminar compound, boric acid compound, and graphite does not need to be specifically defined. The amount of water may be appropriately determined depending on the kinds, the blending proportion and the like of the oxide-based laminar compound and the boric acid compound to be used within a range so as to allow applying the lubricant onto the surface of the tool and workpiece.

A preferable composition of the lubricant of the present invention consists of mica: 10 to 30% as the oxide-based laminar compound, boric acid: 10 to 30% as the boric acid compound, and graphite: 1.0 to 4.5%, the balance being water. While examples of the mica include potassium tetrasilicic mica, sodium tetrasilicic mica, natural gold mica, a most preferable one is sodium tetrasilicic mica, as described above. Dispersants may be contained in the water of the balance.

In the case of a lubricant with such a composition, as will be evident from the after-mentioned example, a lubricating film is uniformly formed, and the lubricant exhibits a high lubricity without remaining on the inner surface of the produced seamless tube so that the occurrence of tube inner surface flaws will not be observed.

While the lubricant of the present invention has the above described configuration, dispersants for improving the uniform dispersibility when sodium tetrasilicic mica, potassium borate, amine borate, and the like are dispersed and mixed in water may be added as needed.

When the lubricant of the present invention is used, it may be applied onto the surface of a hot-rolling tool such as a mandrel bar by means of brushing, spraying, or any other appropriate ways depending on the state of the lubricant (kind among oxide-based laminar compound and boric acid compound, amount of water, and the like).

The surface treatment method for a mandrel bar for use in producing hot rolling seamless tubes according to the present invention is a method in which the above described lubricant of the present invention is applied to the surface of the mandrel bar at the time of mandrel rolling.

To be specific, when performing mandrel mill rolling, the lubricant of the present invention may be applied by spraying or another way onto the surface of the mandrel bar, thereafter being naturally dried in air and solidified. Applying this surface treatment method will result in that a film having a high lubricity and made up of "silicic acid+scale" and "boric acid+scale" is formed on the surface of the mandrel bar.

As a result, since the friction coefficient can be reduced from an early stage of the use of a mandrel bar, and seizure resistance can be improved, it is not necessary to perform a launching rolling for initial use with carbon steel as the workpiece, the launching rolling having been conventionally performed on a newly fabricated mandrel bar particularly when producing hot seamless steel tubes made of high-alloy steel and stainless steel, and therefore it is possible to remarkably improve working efficiency.

If a mandrel bar which has been subjected to the surface treatment method of the present invention is used, the lubricant will not remain on the inner surface of tube after the end of rolling as shown in Examples described below. Moreover, since the blending proportion of graphite is relatively small, there is no risk of carburization. It is noted that the surface treatment method of the present invention is applicable to hot-rolling tools other than the mandrel bar, and capable of making a film having a high lubricity to be formed on the surface to be treated.

EXAMPLES

To confirm excellent lubrication properties of the lubricant of the present invention (that is, a lubricant in which graphite is added to a boric acid-mica based lubricant), and the effect of suppressing the remaining of lubricant on the inner surface of tube, boric acid-mica based lubricants B to G with the graphite content being varied were prepared with a boric acid-mica based lubricant A, which contains no graphite as shown in Table 1, as a base.

Boric acid-mica based lubricant B: graphite content 1.0%
Boric acid-mica based lubricant C: graphite content 2.5%
Boric acid-mica based lubricant D: graphite content 4.5%
Boric acid-mica based lubricant E: graphite content 7.5%
Boric acid-mica based lubricant F: graphite content 10.0%
Boric acid-mica based lubricant G: graphite content 20.0%

The prepared boric acid-mica based lubricants were used to conduct an indoor test (laboratory test) and a full scale test, and the remaining state of lubricant on the inner surface of tube, and the film formation state of on the surface of tool were investigated. It is noted that the remaining state of lubricant and the film formation state were investigated and evaluated by visual inspection and by X-ray analysis as needed.

TABLE 1

| | Composition (mass %) | | | | |
|---|---|---|---|---|---|
| Lubricant | Sodium tetra-silicic mica | Potassium borate | Amine borate | Disper-sant | Mois-ture |
| Boric acid-mica based lubricant A | 15.0 | 8.0 | 8.0 | 2.5 | 66.5 |

[Evaluation by Laboratory Test]

The above described boric acid-mica based lubricants A to G with the graphite content being varied were each applied (by manual application) to the surface of a tool material (SKD6) which is simulated to a mandrel bar, and were naturally dried in air to solidify; and a rolled stock (SUS304 material) was heated at 1100° C. for 15 minutes, subsequently subjected to hot working test (tool feed speed 30 mm/s), and to investigating the presence or absence of the remaining of lubricant and the film formation state on the surface of the tool material.

Investigation results are shown in Table 2. In Table 2, symbol ○ in the column "Lubricant remaining state" represents that the remaining of lubricant is not observed, symbol x represents that the remaining of lubricant is observed, while the symbol ○ is referred to as good in evaluation.

Further, symbol ○ of the column "Film formation state" represents that a film is uniformly formed, symbol Δ represents that a film is formed, but is not uniform, symbol x represents that a film is not formed, while the symbol ○ is referred to as good in evaluation. The column of "Evaluation" represents the evaluation results taking into consideration of rating in both "Lubricant remaining state" and "Film formation state", and the case of symbol ○ (good) means "Excellent".

TABLE 2

| Lubricant | Graphite content (mass %) | Lubricant remaining state | Film formation state | Evaluation |
|---|---|---|---|---|
| Boric acid-mica based lubricant A | 0 | x | ○ | x |
| Boric acid-mica based lubricant B | 1.0 | ○ | ○ | ○ |
| Boric acid-mica based lubricant C | 2.5 | ○ | ○ | ○ |
| Boric acid-mica based lubricant D | 4.5 | ○ | ○ | ○ |
| Boric acid-mica based lubricant E | 7.5 | ○ | Δ | Δ |
| Boric acid-mica based lubricant F | 10.0 | ○ | Δ | Δ |
| Boric acid-mica based lubricant G | 20.0 | ○ | x | x |

As is evident from Table 2, if graphite is contained not less than 1.0%, the lubricant remaining state on the inner surface of tube is fine, absent of the remaining of lubricant. Further, if the content of graphite is not more than 4.5%, the film formation state on the surface of the mandrel bar is fine.

On the other hand, when the graphite content was 7.5 to 10%, a film was formed, but was non-uniform, and when the graphite content was 20%, a film was not formed, so that "Evaluation" was determined as symbol x or symbol Δ, thus being judged to be "Poor".

[Evaluation by Full Scale Test (1)]

For 9%-Cr steel, seamless steel tubes of 45.0 mm in outside diameter and 9.57 mm in wall thickness were produced by a Mannesmann-mandrel mill process by respectively using the following boric acid-mica based lubricants among the lubricants shown in Table 2 described above, as the lubricant.

Boric acid-mica based lubricant A: graphite content 0%

Boric acid-mica based lubricant C: graphite content 2.5%

Boric acid-mica based lubricant D: graphite content 4.5%

Boric acid-mica based lubricant F: graphite content 10.0%

The remaining state of lubricant on the inner surface of tube of the produced seamless steel tube, and the film formation state on the surface of the mandrel bar were investigated, and friction coefficient was evaluated. The investigation of the remaining state of lubricant was performed by visual inspection, and the investigation of the film formation state was performed by visual inspection and X-ray analysis, and the friction coefficient was determined by the afore-mentioned Formula (i).

Figure 2:
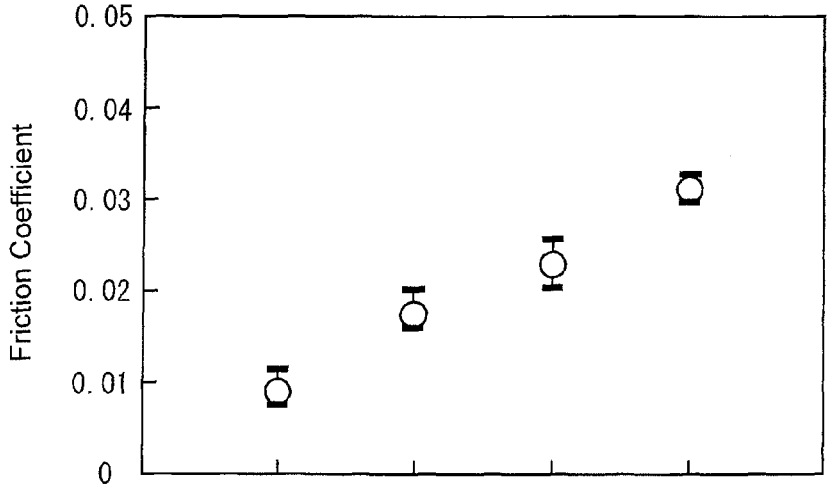
FIG. 2 is a diagram to show the effect of graphite in the boric acid-mica based lubricant on deterring the lubricant from remaining on the inner surface of a seamless tube produced by a Mannesmann-mandrel mill process, as well as on the film formation on the surface of the mandrel bar and on the friction coefficient.

Investigation results are shown in FIG. 2. In FIG. 2, the meanings of symbols ○, Δ and x in the columns "Lubricant remaining state" and "Film formation state" are the same as those in Table 2 described above. Moreover, the friction coefficient was determined for each of a plurality of rolling passes, and the average value (indicated by middle symbol ○) along with the range of the variation is shown for each case of lubricant.

As shown in FIG. 2, while when the boric acid-mica based lubricant A which contains no graphite was used, the lubricant remained on the inner surface of tube, when the boric acid-mica based lubricant C (graphite content 2.5%) and the boric acid-mica based lubricant D (graphite content 4.5%) were used, the remaining of lubricant was not discerned in either case, and the film formation state was fine as well. On the other hand, when the boric acid-mica based lubricant F (graphite content 10.0%) which contains a large amount of graphite was used, a film was formed but was non-uniform. In FIG. 2, boric acid-mica based lubricants are referred to as "lubricants" for simplicity.

On the other hand, although the friction coefficient gradually increased as the graphite content increased, the friction coefficient was considerably small compared with the case where the graphite based lubricant was used (see FIG. 1 described above), and in the cases of the boric acid-mica based lubricants C and D in which not more than 4.5% of graphite was added, the remaining of lubricant was not observed in either case, and the film formation state was also fine, revealing that the both had excellent lubricity.

[Evaluation by Full Scale Test (2)]

As with the above described evaluation (1), for 9%-Cr steel, seamless steel tubes of 45.0 mm in outside diameter and 9.57 mm in wall thickness were produced by the Mannesmann-mandrel mill process by using various boric acid-mica based lubricants (hereafter, referred to simply as lubricants) to investigate the presence or absence of tube inner surface flaws, the film formation state on the surface of mandrel bar, and the remaining state of lubricant on the inner surface of tube. The compositions of the used lubricants are shown in Table 3 (Inventive Examples 1 to 3, and Comparative Examples 1 to 10).

TABLE 3

| Lubricant | | Comparative Examples | | | | | | | | | | Inventive Examples | | |
|---|---|---|---|---|---|---|---|---|---|---|---|---|---|---|
| | | 1 | 2 | 3 | 4 | 5 | 6 | 7 | 8 | 9 | 10 | 1 | 2 | 3 |
| Blended materials (mass %) | Sodium tetrasilicic mica | 10 | 0 | 30 | 40 | 10 | 10 | 10 | 10 | 10 | 10 | 10 | 10 | 10 |
| | Boric acid | 20 | 20 | 20 | 20 | 5 | 10 | 30 | 40 | 20 | 20 | 20 | 20 | 20 |
| | Graphite | — | — | — | — | — | — | — | — | 7.5 | 10 | 1.0 | 2.5 | 4.5 |
| | Dispersant, water | 70 | 80 | 50 | 40 | 85 | 80 | 60 | 50 | 62.5 | 60 | 69.0 | 67.5 | 65.5 |
| Tube inner surface flaws | | ○ | x | ○ | x | x | ○ | ○ | x | ○ | ○ | ○ | ○ | ○ |
| Film formation state | | ○ | x | ○ | ○ | ○ | ○ | ○ | ○ | Δ | Δ | ○ | ○ | ○ |
| Lubricant remaining state | | x | x | x | x | x | x | x | x | ○ | ○ | ○ | ○ | ○ |

Investigation results are collectively shown in Table 3. In Table 3, symbol ○ in the column "Tube inner surface flaws" represents that the occurrence of flaws is not discerned, and symbol x represents that flaws occurred on the inner surface of tube. Further, what symbols ○, Δ and x mean in the columns "Film formation state" and "Lubricant remaining state" are the same as what they mean in above described Table 2.

As shown in Table 3, when the lubricants of Comparative Examples 1 to 8 were used, since no graphite was contained, particularly as for "Lubricant remaining state", symbol x was seen in any case, meaning that the remaining of lubricant was observed in any case. Moreover, in Comparative Examples 9 and 10, since a large amount of graphite was contained, "Film formation state" was such that a film was formed, but was non-uniform.

In contrast to this, when the lubricants of Inventive Examples 1 to 3 were used, in all of the investigation items of "Tube inner surface flaws", "Film formation state", and "Lubricant remaining state", symbol ○ is seen. As a result of this, it has been confirmed that the lubricant for hot-rolling tools of the present invention has an excellent lubrication property, and an effect of suppressing the remaining of lubricant on the inner surface of tube.

INDUSTRIAL APPLICABILITY

The lubricant for hot-rolling tools of the present invention is a lubricant in which an oxide-based laminar compound, a boric acid compound, and graphite are dispersed and dissolved in water, and which is excellent in seizure resistance and also satisfactory in workability. According to the surface treatment method for a mandrel bar of the present invention in which the above described lubricant is applied to the surface of the mandrel bar, it is possible to cause a lubricating film to be formed on the surface of the mandrel bar and to exert excellent seizure resistance at the time of mandrel mill rolling. Further, the lubricant is immune from remaining in the inner surface of tube.

In particular, when producing a hot rolling seamless tube made of high-alloy steel and stainless steel by using a newly fabricated mandrel bar, since it is not necessary to perform a launching rolling for initial use which is needed when a conventional graphite based lubricant is used, it is possible to remarkably improve working efficiency.

Therefore, the lubricant for hot-rolling tools of the present invention, and the surface treatment method for a mandrel bar of the present invention can be effectively utilized for hot rolling, particularly for the production of hot rolling seamless tubes.

What is claimed is:

1. The lubricant for hot-rolling tools consists of an oxide-based laminar compound, a boric acid compound, graphite, a dispersant, and water, wherein the oxide-based laminar compound, the boric acid compound, and the graphite are dispersed and dissolved in the water, the blending proportion of the oxide-based laminar compound to the boric acid compound is 10:90 to 70:30 in mass ratio, and the content of graphite is 1.0 to 4.5%, and the composition of the lubricant further consisting of, in mass %, mica: 10 to 30% as the oxide-based laminar compound, boric acid: 10 to 30% as the boric acid compound, and graphite: 1.0 to 4.5%, the balance being water containing said dispersant.

2. A surface treatment method for a mandrel bar for use in producing hot rolling seamless tubes comprising the step of applying a lubricant for hot-rolling tolls to a surface of the mandrel bar at a time of mandrel mill rolling, wherein the lubricant consists of an oxide-based laminar compound, a boric acid compound, graphite, a dispersant, and water, wherein the oxide-based laminar compound, the boric acid compound, and the graphite are dispersed and dissolved in the water;

the blending portion of the oxide-based laminar compound to the boric acid compound is 10:90 to 70:30 in mass ratio, and the content of the graphite is 1.0 to 4.5%, and the lubricant consists of, in mass %, mica: 10 to 30% as the oxide-based laminar compound, boric acid: 10 to 30% as the boric acid compound, and graphite: 1.0 to 4.5%, the balance being water containing said dispersant.

* * * * *